US006571912B2

(12) United States Patent
Söll

(10) Patent No.: US 6,571,912 B2
(45) Date of Patent: Jun. 3, 2003

(54) FALLING SAFEGUARD DEVICE

(75) Inventor: Peter Söll, Hof (DE)

(73) Assignee: Christian Dalloz Holding Deutschland GmbH & Co. KG, Hof (DE)

( * ) Notice: Subject to any disclaimer, the term of this patent is extended or adjusted under 35 U.S.C. 154(b) by 0 days.

(21) Appl. No.: 10/167,973

(22) Filed: Jun. 11, 2002

(65) Prior Publication Data

US 2002/0148682 A1 Oct. 17, 2002

Related U.S. Application Data

(63) Continuation of application No. 09/530,049, filed as application No. PCT/EP98/06946 on Nov. 3, 1998, now Pat. No. 6,425,458.

(30) Foreign Application Priority Data

Nov. 3, 1997 (DE) ..... 297 19 485 U

(51) Int. Cl.[7] ..... A62B 1/16
(52) U.S. Cl. ..... 182/36; 104/93
(58) Field of Search ..... 182/3, 36, 8; 104/93, 104/111

(56) References Cited

U.S. PATENT DOCUMENTS

| | | | | |
|---|---|---|---|---|
| 1,411,234 A | * | 3/1922 | Butler | |
| 3,410,364 A | | 11/1968 | Fountain | |
| 4,269,284 A | | 5/1981 | Swager | |
| 4,572,329 A | * | 2/1986 | Kleveborn | 182/135 |
| 4,674,596 A | | 6/1987 | Weiner et al. | |
| 5,358,068 A | | 10/1994 | Whitmer | |
| 5,653,172 A | | 8/1997 | Roschier | |
| 5,934,408 A | | 8/1999 | Flux | |
| 6,125,766 A | | 10/2000 | Flux | |

FOREIGN PATENT DOCUMENTS

| | | | | |
|---|---|---|---|---|
| DE | 1 980 356 | | 3/1968 | |
| DE | 1 961 757 | | 6/1971 | |
| DE | 26 26 425 | A1 | 12/1977 | |
| DE | 30 23 489 | A1 | 1/1982 | |
| DE | 296 10 333 | U1 | 10/1996 | |
| DE | 196 34 030 | A1 | 2/1998 | |
| EP | 0 129 241 | A2 | 12/1984 | |
| EP | 0 157 072 | B1 | 10/1985 | |
| FR | 2 437 846 | | 6/1980 | |
| GB | 2 063 800 | A | 6/1981 | |
| GB | 2063800 | A * | 6/1981 | ..... B61B/13/00 |
| GB | 2 256 408 | A | 12/1992 | |
| GB | 2 322 109 | A | 8/1998 | |
| WO | WO 82/03015 | | 9/1982 | |
| WO | WO 91/17795 | | 11/1991 | |
| WO | WO 94/04786 | | 3/1994 | |
| WO | WO 95/15790 | | 6/1995 | |

* cited by examiner

*Primary Examiner*—Alvin Chin-Shue
(74) *Attorney, Agent, or Firm*—Hoffmann & Baron, LLP

(57) ABSTRACT

The device for securing people against a fall has a rail which is fastened by means of holders, and a runner which is guided along the rail. The rail is held movable in its longitudinal direction in the holders. The rail preferably has a closed hollow profile with roughly square cross-section and with flanges pointing away from each other on each of two opposite-facing side surfaces of the cross-section profile, the cross-section profile of the rail being symmetrical about the horizontal and the vertical axis. At least one end of the rail is preferably held in a path force limiter, which opposes a pre-set resistance to a movement of the rail.

4 Claims, 13 Drawing Sheets

FALLING SAFEGUARD DEVICE

Figure 1:
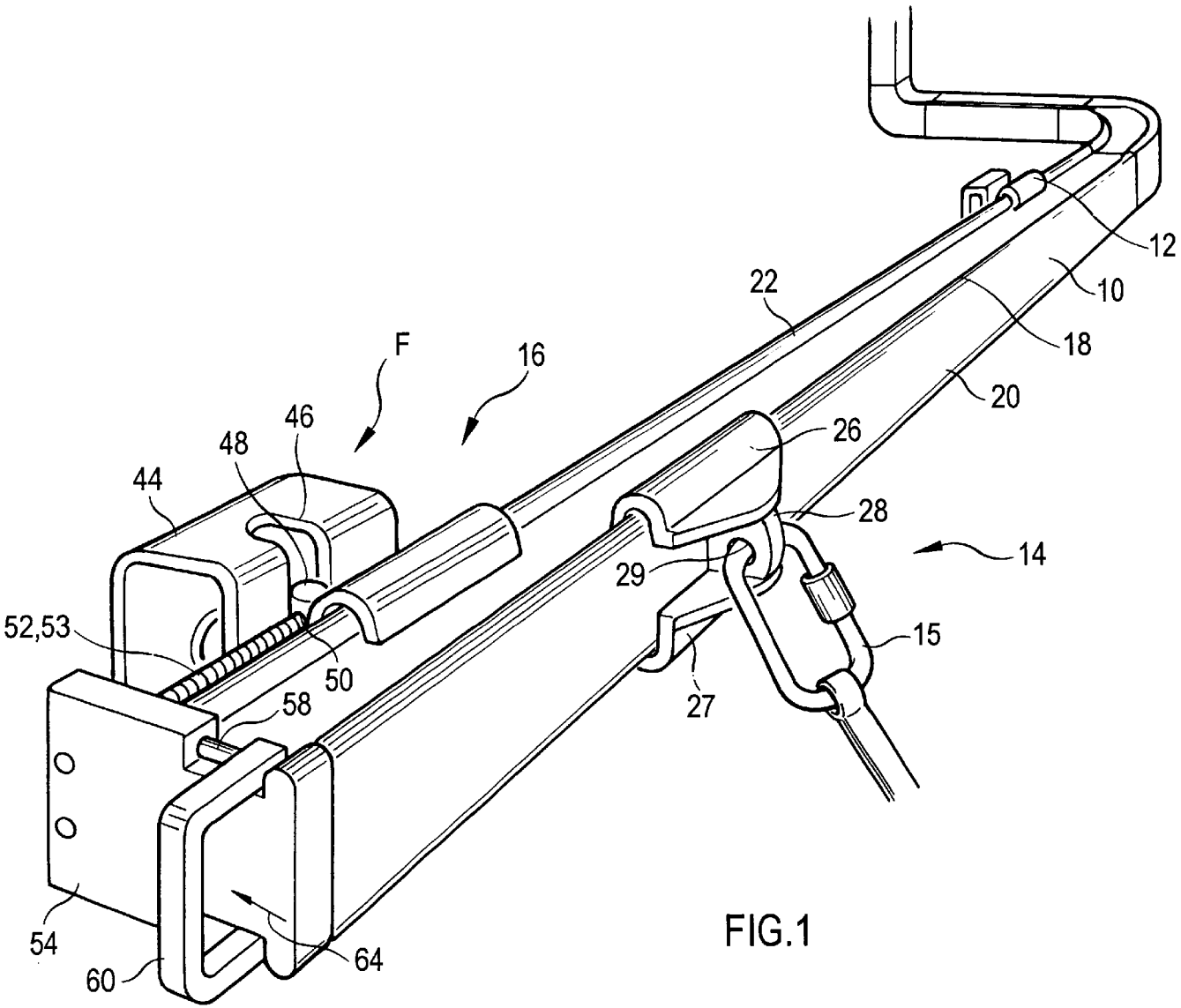

This application is a continuation of copending application Ser. No. 09/530,049 filed Apr. 20, 2000, U.S. Pat. No. 6,425,458, issued Jul. 30, 2002, which is a 371 of PCT/EP98/06946. filed Nov. 3, 1998.

The invention relates to a device which safeguards people against falling. To this end, the device has a rail which is supported by holders, as well as a runner which is guided along the rail and functions as a movable attachment point.

Such falling safeguard devices are needed when climbing ladders on broadcasting masts or chimneys, on crane runways, in the field of shipping, for cleaning facades and in similar cases where there is the danger of falling. A ladder with such a falling safeguard device is known from DE-C-1 961 757. A falling safeguard device for ladders is known from EP-A[P]-0 129 241 where an apparatus is provided half way up for horizontal displacement of the attachment point. An attachment device for safeguarding people against falling is known from DE-U-295 17 560 and with which the rail can run both horizontally and vertically. The guide rail for the carriage or the fall arrest equipment has a profiled longitudinal section which is fastened by means of a screw to a mounting bracket which is fastened for example to a crane runway or a roof edge. Falling safeguard devices are also known in which the fall arrest equipment is guided along a rope. Difficulties can arise with such falling safeguard devices from uncontrolled elongation of the guide rope. In addition, there is the visual problem associated with the sag of the rope, which adversely affects the overall visual impression, particularly for facades.

The object of the invention is to create a falling safeguard device which offers complete security against a fall in spite of its comparatively light and filigree construction.

According to the invention, this object is achieved in that the guide rail is mounted movable in the holders in its longitudinal direction.

A floating mounting of the guide rail is achieved through the movable securement of the guide rail so that the rail cannot exert any great force on the holders in the longitudinal direction. When a person falls, the rail is deflected at the attachment point and the overall length of the rail is thereby shortened. The extension of the rail is negligible and the rail acts as a tension bar. The capture impact spreads over the entire length of the rail and is finally conducted into a path force limiter which is provided at one or both ends of the rail. Through the design and construction of the path force limiter(s), the forces occurring when someone falls and the path of the fall can be controlled.

The floating or movable mounting of the rail in the holders is preferably achieved in that the holders partly grasp around the rail and an insert of friction-reducing material, for example PTFE, is located inside the enclosure. As a result, at the same time, an electrical insulation of the rail vis-à-vis the holders and for example the beam of a crane, and a thermal insulation vis-à-vis a building facade (cold bridge) is achieved.

The rail is designed so that it resists a basic load without permanent deformation. The basic load is the load which occurs during everyday operation, i.e. without someone falling. The exertion of a force of 1 kN is assumed, for example, as the basic load. Such a force is exerted on the rail to the maximum extent by a secured person when the person pushes against the rail. In order that the rail does not deform in the case of such a basic load of retaining forces and does not yield to the forces by tipping onto its weak side and then only the lesser section modulus becomes effective, the rail itself preferably has a closed, roughly square box section with horizontal and vertical section moduli of equal size. Two opposite-facing sides of the box section each have flanges lying in the plane of the side concerned, pointing in opposite directions. This side is called the "flange side" in the following. A groove is formed between the flanges and this side is called the "groove side" of the rail in the following. The profile is symmetrical about both its vertical and its horizontal axis. One of the flange pairs serves to guide the runner while the other flange pair serves to mount the rail in the holders in a floating manner.

An advantage of the box section of the rail is that individual rail pieces can be joined together without any problems, by inserting, at the joint, a connection piece into the rail-ends to be joined and fixing it there by cross-bolts. The flanges are preferably hollow, i.e. the internal cavity of the rail also extends into the flange. The connection piece is developed so that it fills the cross-section of the entire cavity and accordingly also has flanges. The flanges of the rail are therefore also reinforced by the connection piece. The runner slides over such a joint without any problems. By including such a solid element of greater length into the hollow box section, the moment of resistance of the rail can be further increased. This can conveniently be e.g. in the center between two widely separated holders. The rail can also be reinforced by doubling it. This can be achieved by securing two rails together, the one flange pair of one rail then lying against a flange pair of the other rail.

The box section with two flange pairs can also be shaped into stable curved pieces. However, the preferred method for producing bends is to turn rings on a lathe with a profile which corresponds to the outer profile of the rail. Angle sections of the curved pieces are then separated out from these rings as necessary. These bends are made of solid material. Connection pieces with a central screw are fitted onto the end- or cut-surfaces of these rings. These connection pieces correspond to the joining pieces, but are however only roughly half as long. Because they are screwed on with a central, tangentially running screw, the connection pieces can be rotated about this central screw, under a greater load in order to remove the rotation resistance. Forces are thereby likewise absorbed if someone falls, the theoretical point for the rotation being created by screwing the connection piece tight against curved piece so that the plastic deformation of the rail piece adjoining it is largely avoided.

In order to improve the cornering motion, the flanges of the curved pieces are preferably somewhat thinner than those of straight rail pieces if the curve lies in the plane of the groove side of the rail. On the other hand, if the curve lies in the plane of the flange side of the rail, the flanges can optionally be selected somewhat lower in order to improve the cornering motion on the curved pieces. The double symmetrical profile of the rail simultaneously has the advantage that all rail courses can be realized with one vertical and one horizontal curved piece. As curved pieces can easily cause restrictions in sliding capacity and thus the running behavior of the runner, the curved pieces can also be completely coated with a plastic which improves the sliding capacity, e.g. PTFE.

To avoid contact corrosion at the interface between the rail made from stainless steel and the curved piece made from aluminium, the curved piece is preferably anodised as a whole or coated with a plastic, this function also being able to be fulfilled by the previously mentioned PTFE coating.

A further advantage of the profile of the rail being symmetrical about the horizontal and vertical axis is that if several people are secured on a rail, two people can pass each other if one person temporarily attaches his runner on the opposite-facing side of the rail at which the holders normally engage.

It can become necessary, in particular for greater rail lengths or tight enclosures, to provide expansion joints at intervals. For such expansion joints, joint pieces are used which are designed similarly to the above-mentioned connection pieces, onto which however only one rail piece is securely mounted. On the other hand, the other rail piece can travel for a certain distance on the joint piece. To this end, two opposing recesses are milled into the joint piece, in which groove blocks slide which are screwed fast to the movable rail piece. This design is advantageous vis-à-vis the oblong hole milled by the complete profile of the joint piece, as this could cause an excessive weakening of the material cross-section.

The holders are preferably formed as U-brackets, the closed end of which points downwards, one U-leg being fastened to the load-bearing structure, for example the masonry, while a claw, which clips round a flange pair of the rail, is fastened to the other U-leg. The claw is preferably centrally screwed fast or welded onto the U-leg so that the direction of force points through the center of the rail and no tilting moment is exerted on the rail. Because the closed side of the U-bracket points downwards, the U-bracket of the holder is opened in the event of a fall and can thus absorb drop energy and at the same time deform in the direction of pull. This deformation is facilitated by a vertical slit. Since forces pointing in the longitudinal direction of the rail do not act on the holder because of the movable mounting of the rail in the holder only light loads occur at the holder and no damage occurs at the facade in the event of a fall.

In the case of greater distances between the individual holders, it can be expedient to fasten the rail to the facade between two holders with simple fastening clips, the holders being e.g. stuck fast onto the facade. The fastening clips are conceived as holders with defined disengaging or releasing function and have no security function, but serve only to prevent a sagging of the rail and to introduce small retaining forces. They are intended to resist the above-mentioned basic load and hold the rail with up to a load of 1 kN for example. Instead of this, a holder with a corresponding releasing force can be attached to the facade. In the event of a fall, the rail loosens itself from the fastening clip or the entire holder from the fastening clips so that no damage occurs to the facade.

The runner functioning as an attachment point grasps around a flange pair and slides on this flange pair. To this end, it can be provided with a sliding, e.g. PTFE, insert or coating on the inside. To be able to better travel over the curved pieces of the rail, the side of the runner is provided with an insert only at the front and back ends of the runner. The insert is designed as a moulded piece having projections which click into corresponding openings in the body of the runner or are locked into it. The runner can also be coated with a slide coating likewise e.g. from PTFE according to a known process.

If there is no slide insert or coating, the runner is provided with an inwardly projecting, reinforced edge at its front and back end up to the rail. These reinforced edges lie against the rail. Through precise working of these edges the running properties of the runner can be improved, above all on curved pieces. These reinforced edges mean moreover that the inside of the runner is undercut and thereby does not engage with the rail, at least on straight rail pieces.

The device according to the invention can be used for safeguarding people against falling both on vertical climbing tracks and on horizontal sections. For vertical climbing tracks the runner is designed such that it blocks against a downward movement in the event of a fall.

In its simplest form the runner can be built up from two half-shells each of which grasps around a flange of the rail. The two half-shells are connected by a block which has a bore, in which the snap hook of the safety harness is suspended. Such a rigid runner can be placed only at end of the rail.

In another version, the two half-shells of the runner are provided with pipe bushing, with which the half-shells can be pushed onto at an axis. In their closed position, in which they tightly grasp around the flange of the rail, the half-shells are secured by a milled nut which can be screwed onto the end of the axis and by a safety stirrup. A swivellable arrester lever also sits in the piece of the axis lying between the half-shells. The lever has two lever arms of different lengths. An opening is provided on the longer lever arm, for suspending the snap hook of the safety harness while the length of the shorter lever arm is chosen so that it presses against the rail and thereby blocks the runner through friction locking on the rail in the case of a vertical climbing track if a downwardly directed force is exerted on the longer lever arm. The axis can be deflected in the form of an eccentric or offset in the area in which the lever arm is housed on it. By rotating the axis, the distance of the fulcrum of the lever arm can thus be shifted towards the rail and away from the rail. If the fulcrum is shifted towards the rail, the blocking function results. If, on the other hand, the fulcrum is shifted away from the rail the shorter lever arm does not impact against the rail in the event of a swivel motion and thus there is no blocking function. The axis can be fixed in both positions by means of guided safety stirrup. The effect of the guiding is that the safety stirrup can be swivelled into its fixed position only when the shaft is actually fixed. A runner developed in this manner with an engageable and disengageable arrester function and/or which can be opened and closed to connect at any desired point of a rail can also be used with other types of rails and security systems and thus represents an independent invention.

The arresting or blocking of the runner on the rail can take place through form-locking in the case of a vertical climbing track. To this end, catching stops, against which an arrester hook arranged on the lever arm of the runner runs, are arranged on the rail at regular intervals. Reference is made to DE-C-1 961 757 as regards details of such a form-locking arrester apparatus.

An embodiment of the invention is explained in the following by means of the diagram. There is shown in:

FIG. 1 the horizontal rail with the runner, a holder and a path force limiter;.

Figure 2:
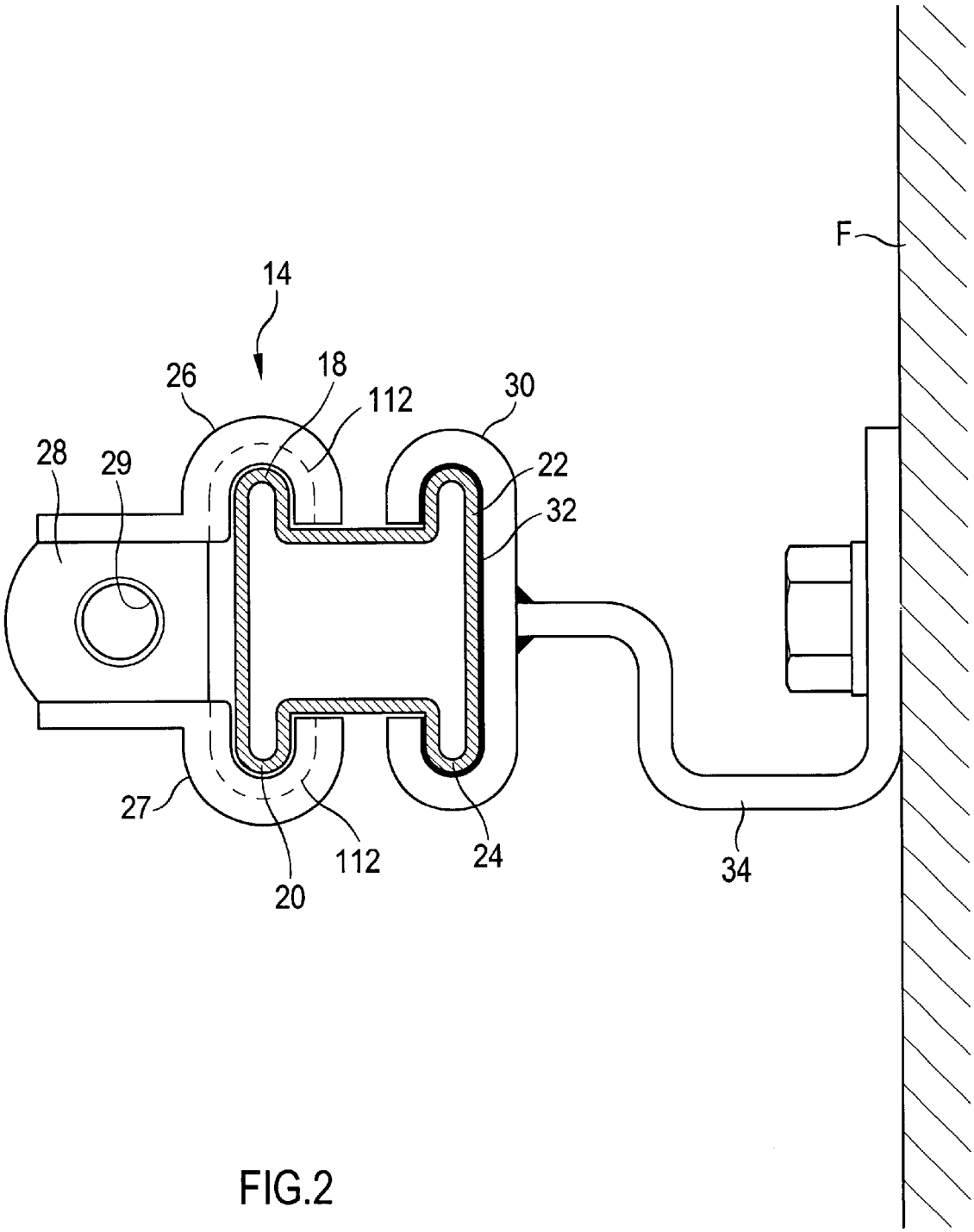
Figure 3:
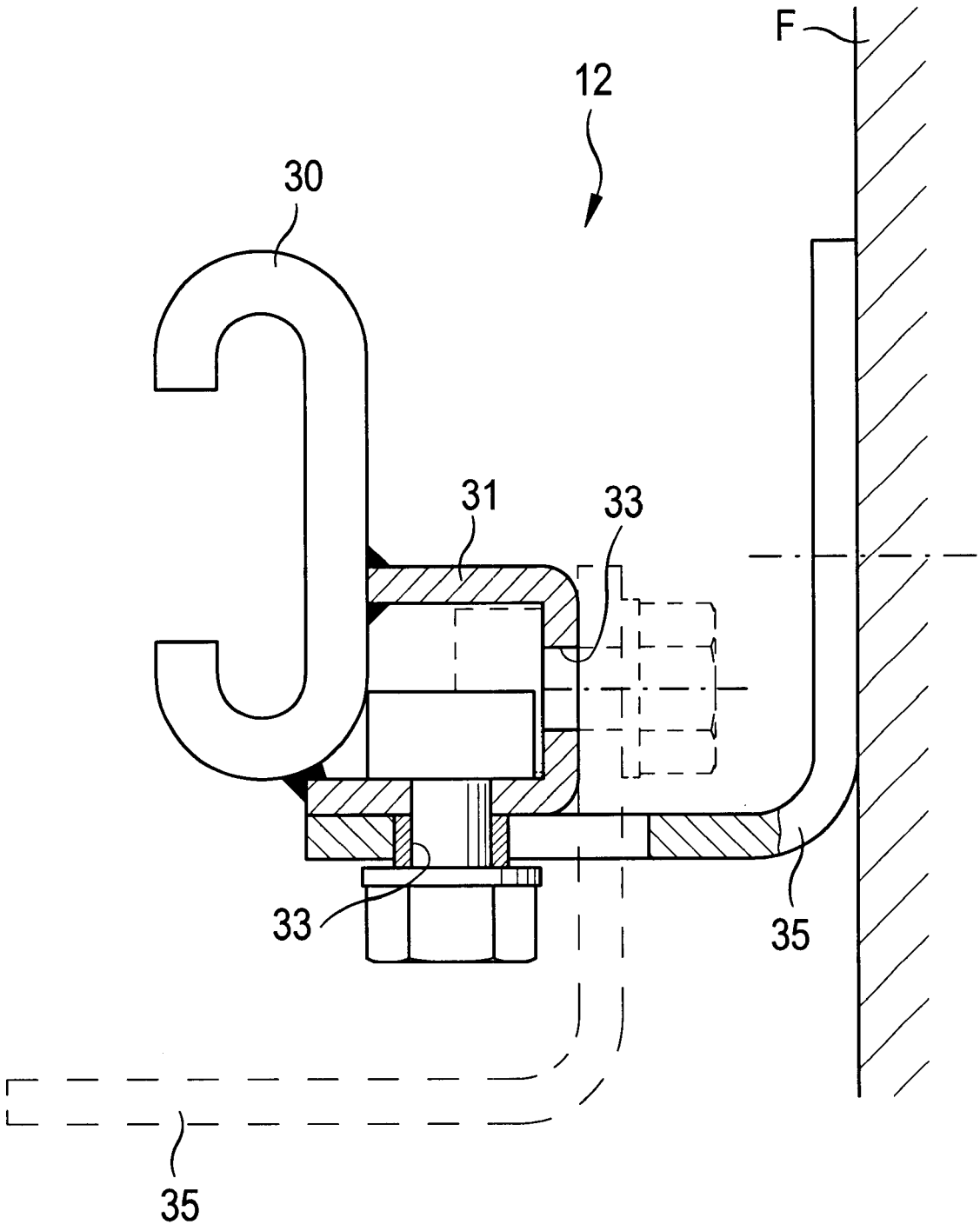
Figure 4:
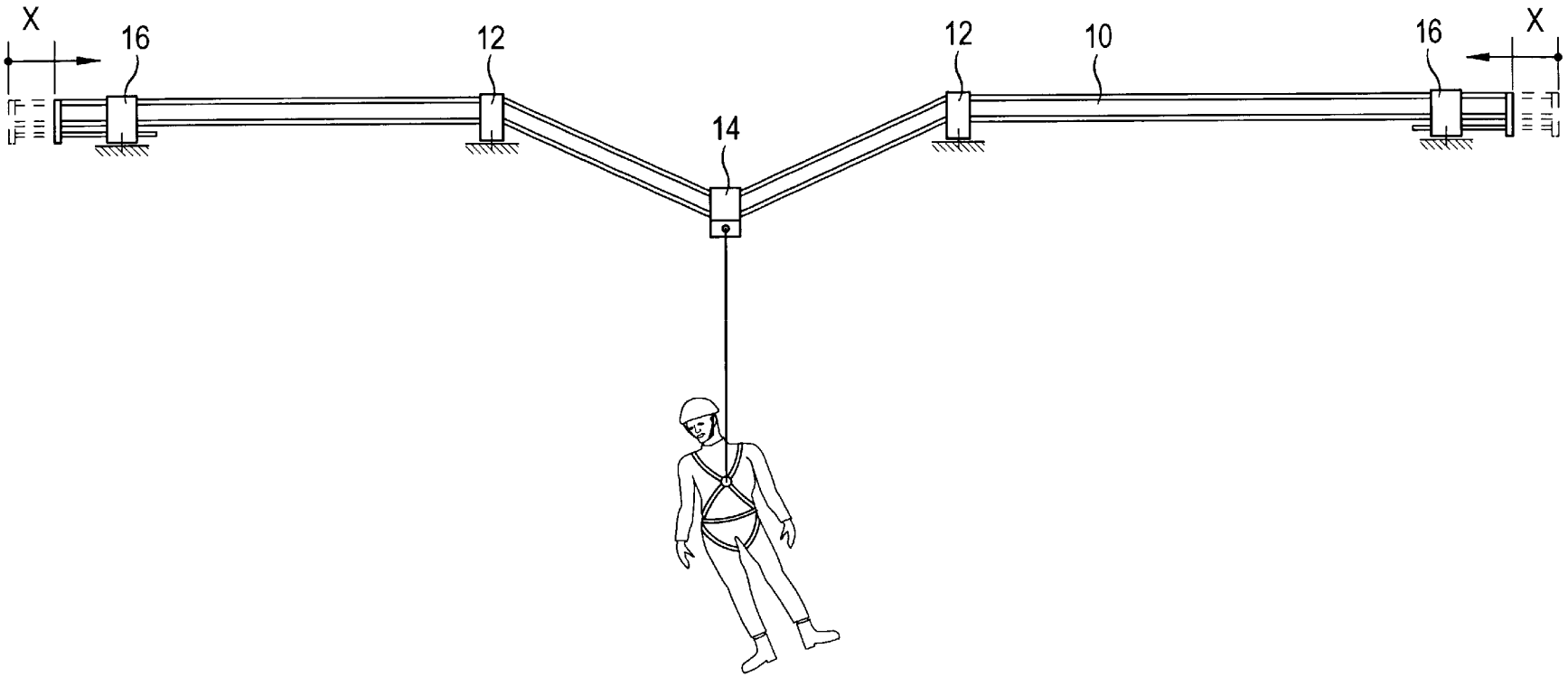
Figure 5:
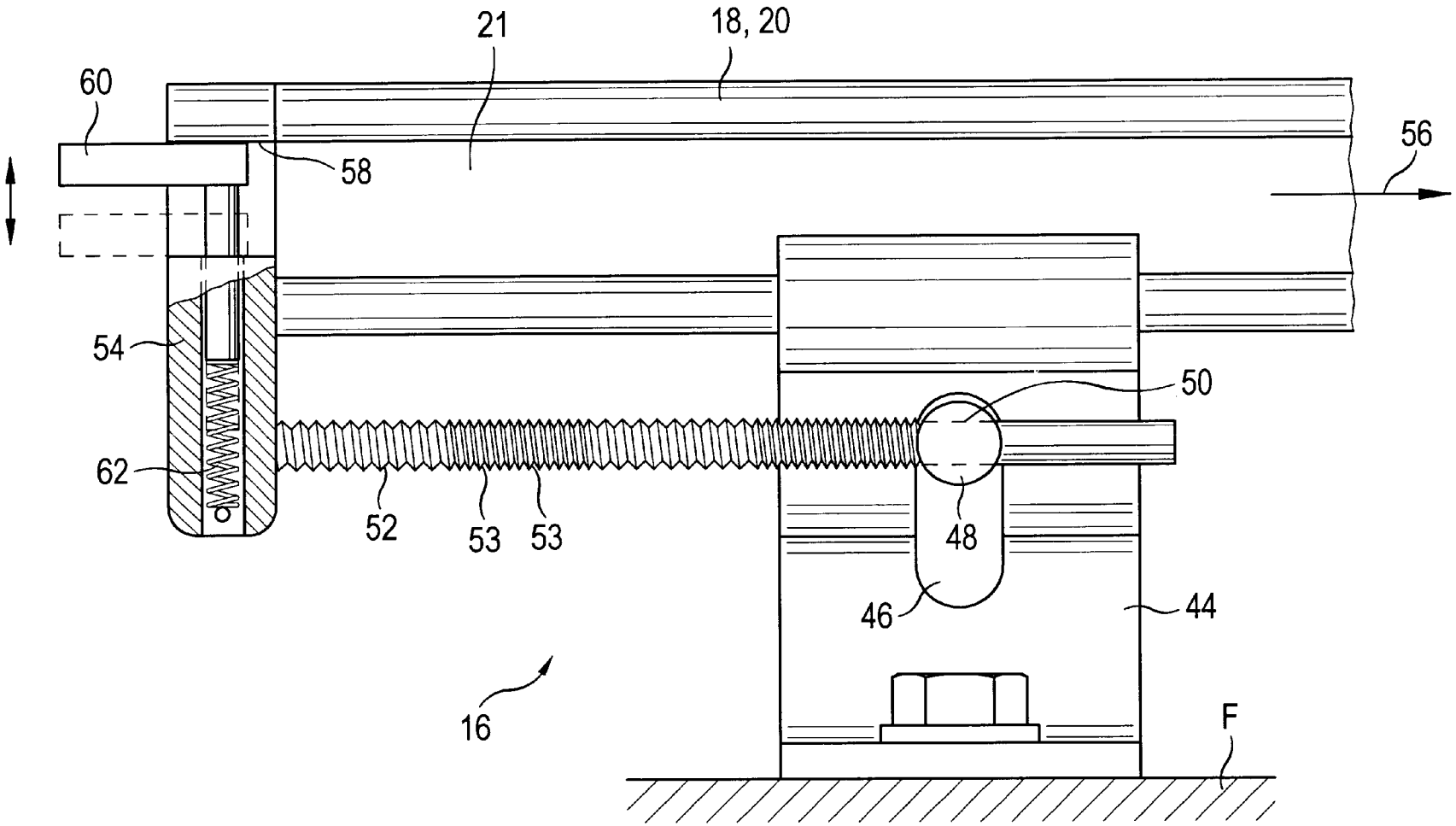
Figure 6:
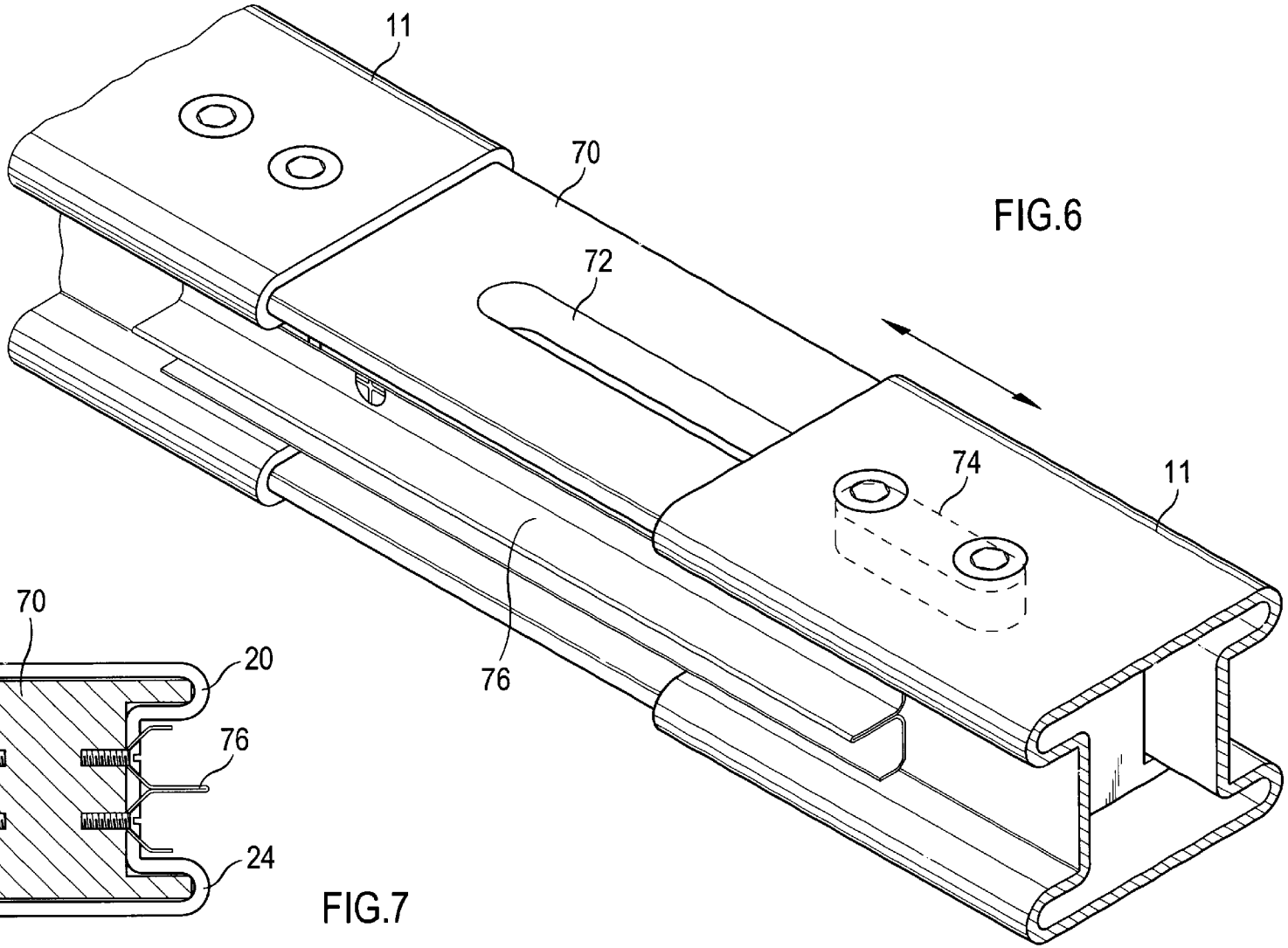
Figure 7:
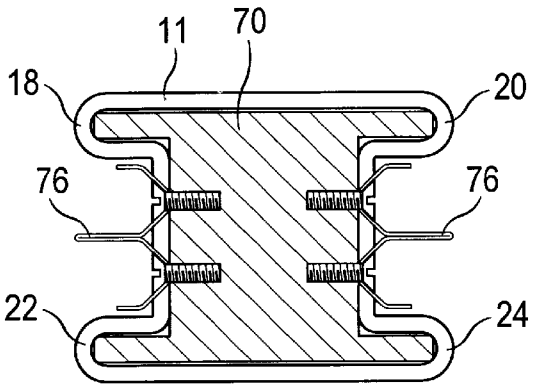
Figure 8:
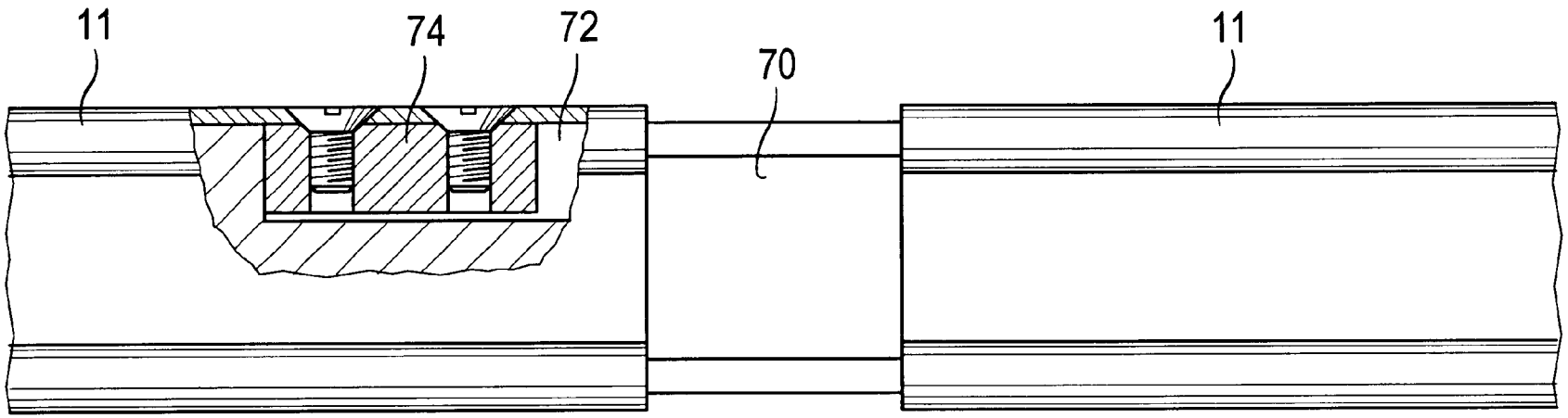
Figure 9:
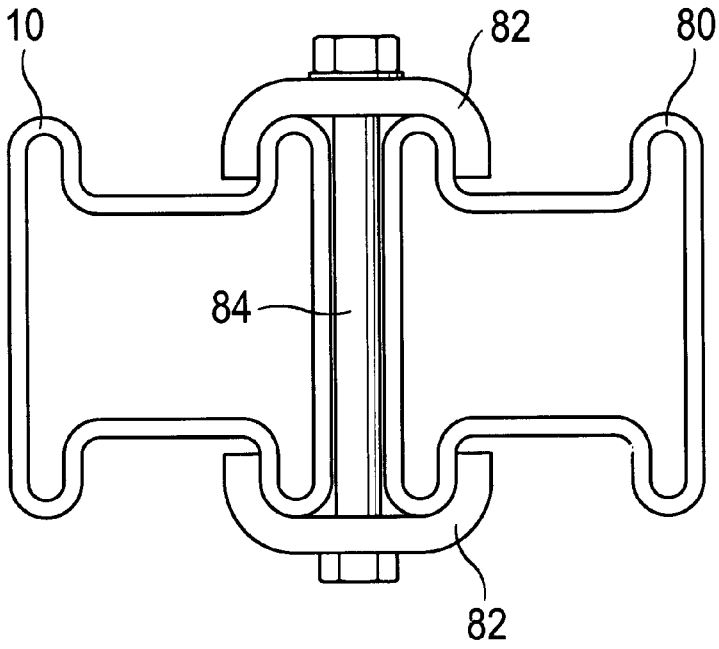
Figure 10:
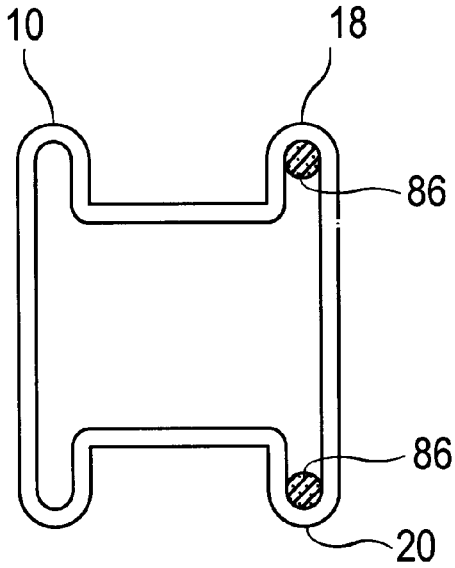
Figure 11:
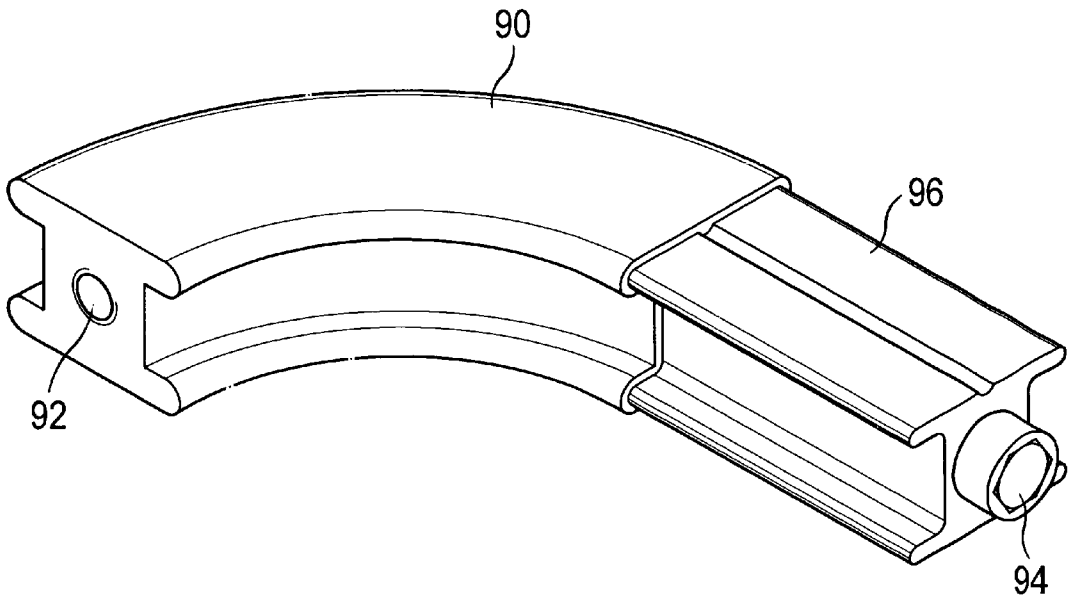
Figure 12:
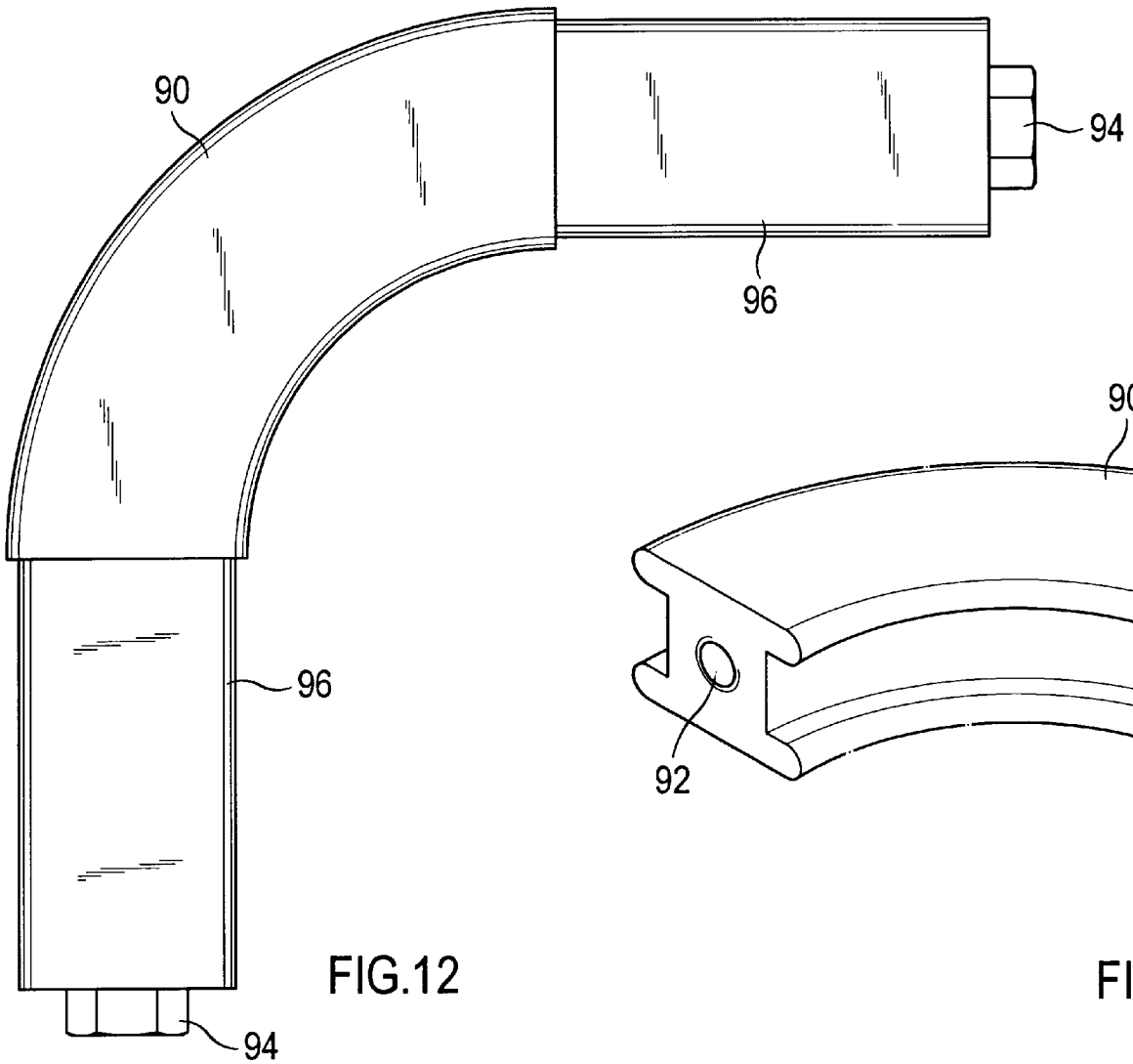
Figure 14:
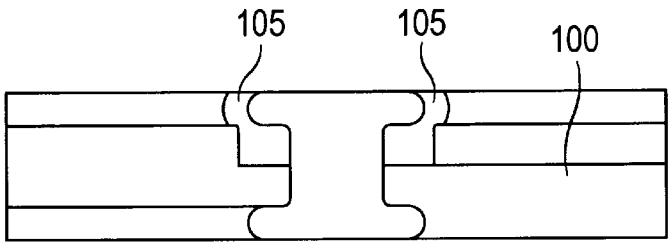
Figure 13:
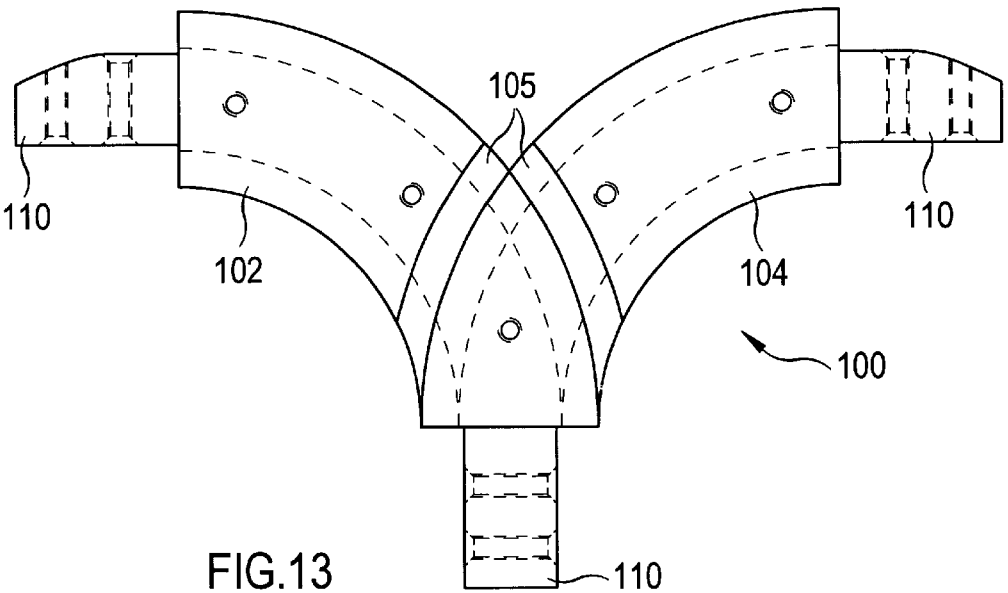
Figure 15:
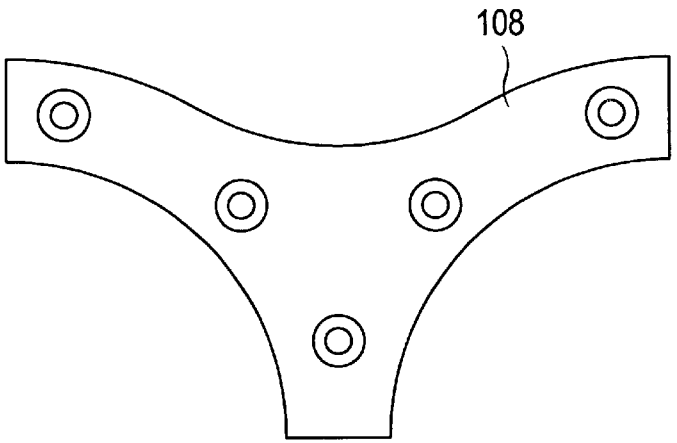
Figure 16:
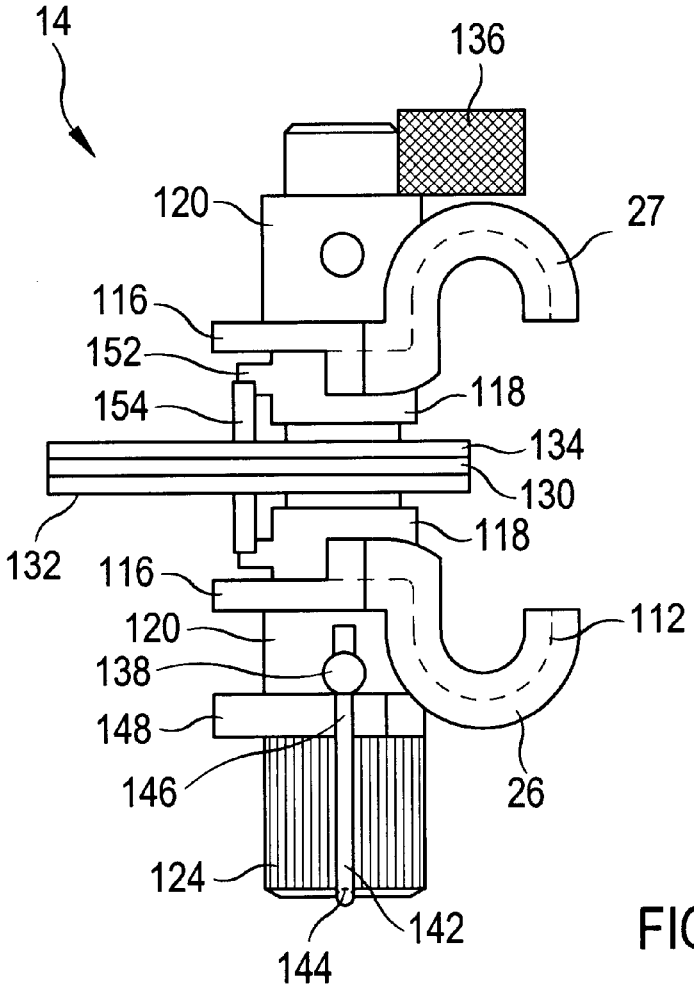
Figure 20:
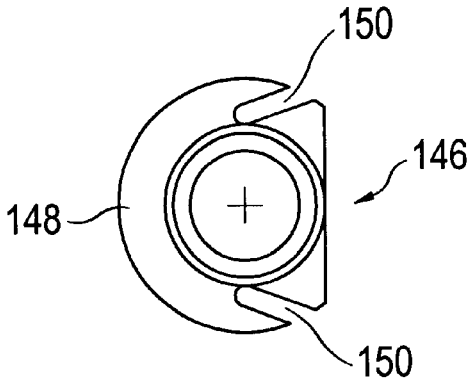
Figure 17:
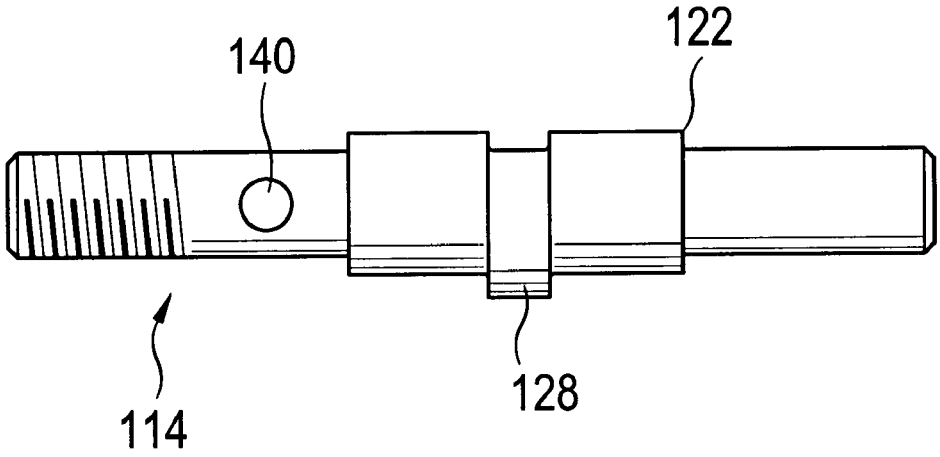
Figure 18:
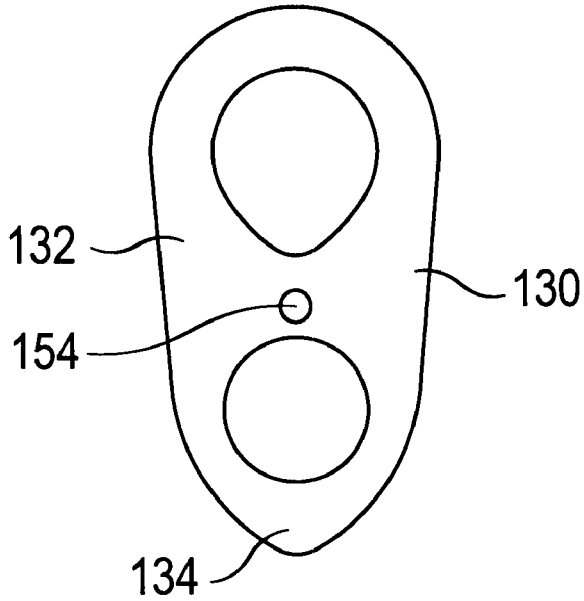
Figure 19:
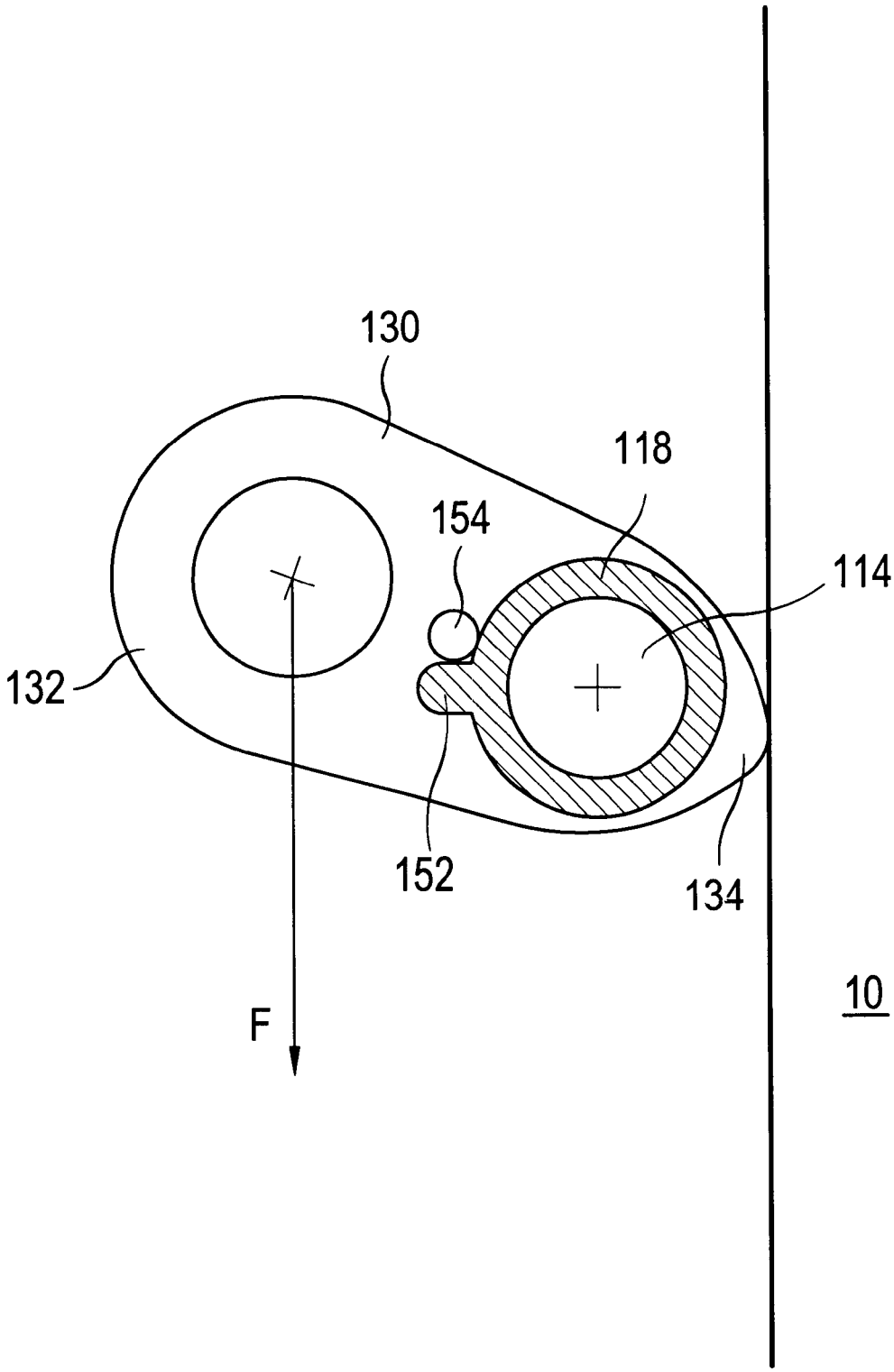

FIG. 2 in sectional representation the horizontal rail with the runner and the holder, FIG. 3 in sectional representation a two-part holder which is suitable for fastening the rail both onto a vertical wall and onto a horizontal surface;

FIG. 4 the horizontal rail in the deflected state after a person has been caught;

FIG. 5 in top view a path force limiter at the end of the rail;

FIG. 6 in perspective representation an expansion joint;

FIG. 7 the attachment of a substitute guide in the area of the expansion joint;

FIG. 8 in partial section the attachment in movable manner of one rail piece at the expansion joint;

FIG. 9 in section a rail reinforced by a second parallel running rail;

FIG. 10 the arrangement of heating strips inside the box section of the rail;

FIG. 11 in perspective representation a rail bend with a connecting piece;

FIG. 12 a rail bend in top view with two connecting pieces;

FIG. 13 a rail switch point in top view;

FIG. 14 the rail switch point from FIG. 13 seen from the front;

FIG. 15 a reinforcing element of the rail;

FIG. 16 a runner with arrester function, which can in addition be opened;

FIG. 17 the eccentric axis of the runner from FIG. 16;

FIG. 18 the arrester lever of the runner according to FIG. 16;

FIG. 19 in schematic representation the mode of operation of the arrester lever from FIG. 18; and FIG. 20 the sliding block of the runner according to FIG. 16.

As is shown in FIG. 1, a rail 10 is fastened to a facade F by means of holders 12. A runner 14, by which a person can be secured by means of a snap hook 15, is guided on the rail 10. The end of the rail 10 is held in a path force limiter 16.

The roughly square box section of the rail 10 is represented in the sectional representation of FIG. 2. Two opposite-facing sides of the box section are each widened by two internally hollow flanges 18, 20 and 22, 24 respectively. The profile of the rail is thereby symmetrical to both a horizontal and a vertical center line. As the rail 10 has a closed box section, the section modulus is roughly the same in both the vertical and horizontal directions. For lighter loads, the box section of the rail 10 can be left open. In the embodiment shown, the rail 10 has outside measurements of 35×45 mm, a flange height of 9 mm and a flange width of 8 mm, so that the width of the groove between the flanges is 19 mm and the outside measurement of the rail, measured in these grooves, is 27 mm. The rail has a wall thickness of 2 mm and is made from high-grade steel. The rail 10 is shaped in numerous steps by cold-rolling, resulting in high material strengthening particularly in the flange areas because of the small bending radii present there. With such a rail 10, holder distances of approx 6 m can be achieved.

The holder 12 has a claw 30 which grasps around the flange pair 22, 24. The inside of the claw 30 has a PTFE insert 32, as a result of which the rail 10 can be displaced in the claw 30 in the event of a load. The rail 10 is thereby mounted in a floating manner. The claw 30 is welded centrally to the end of one leg of a U-bracket 34 open to the top. The other leg of the U-bracket 34 is anchored onto the facade F.

FIG. 3 shows a holder 12 which is designed in two parts and is suitable for fastening the rail 10 onto both vertical and horizontal surfaces. Welded onto the claw 30 is a small support 31, which has two bores 33 on the underside and on its vertical rear side so that it can be screwed tight to a single angle bracket 35 and permits two positions of the angle bracket. The second position which the angle bracket 35 has when fastened on a horizontal surface is drawn in dashed lines in FIG. 3.

The runner 14 is guided on the other flange pair 18, 20. The runner 14 has PTFE inserts or inwardly-projecting edges at the ends and grasps around the flange pair 18, 20. For fixing the PTFE insert, a nose is pressed out in the runner 14 in order to be able to clip the inserts fast at this point. The PTFE inserts are thereby easily replaceable. This is advantageous as the PTFE inserts are exposed to wear and tear when they are used. The runner 14 represents the attachment point of the security system and has a fastening lug 28, from which a safety belt can be suspended for securing a person by means of the snap hook 15.

FIG. 4 shows the deflection of the rail 10 when a load is placed on it, the rail 10 being deflected approx 1 m in the event of an extreme fall. The deflection leads to a longitudinal stress inside the rail and, as the rail 10 is mounted in a movable or floating manner in the holders 12, to a longitudinal movement of the rail 10 by the amount X. Because the rail 10 is mounted in a floating manner, the longitudinal stress does not cause a deformation of the holders 12 in the direction of the rail 10, i.e. in the present case horizontally, but rather the holders 12 lying nearest the point of fall are merely bent downwards. These holders 12 must naturally be replaced, while the facade F is not damaged in the event of such a bending of the holders 12. The longitudinal movement of the rail 10 is absorbed by the path force limiter 16 which is arranged at the end of the rail 10. The distance between the holders 12, the moment of resistance of the rail 10 and the characteristic curve of the path force limiter can be set such that the catching force acting on the person and the fall path are minimized.

The path force limiter 16 is represented in FIG. 5. The path force limiter 16 contains a support 44, which is fastened to the structure, the crane or the like and in the present case to the facade F. The support 44 is equivalent to the holder 12 of FIG. 2. A bolt 48 with two cross-bores 50 at the ends of the bolt extends through a bore of the support 44, the set of ends of the friction elements 52, which resemble threaded rods, extending through said cross-bores. The other ends of the friction elements 52 are fixed to an end-plate 54, which terminates the rail 10 and is fastened to its end. The support 44 has an oblong hole 46 at its center, which weakens the support 44, which contributes to the deflection of the rail and attenuation of the catching impact. A corresponding oblong hole is conveniently also present for the holders 12, but is not shown in the diagram. The deflection of the rail 10 is thereby facilitated.

Upon a longitudinal movement of the rail 10 in the direction of the arrow 56, the friction elements 52 are forced through the cross-bores 50 of the bolt 48. The threads 53 of the friction elements 52 are deformed and pressed flat, thereby providing considerable resistance which opposes the longitudinal movement of the rail 10, which would be triggered by a fall of a person secured onto it, and the drop energy is consumed. Through the height of the threads 53, the distances between them and their width, a specific friction force can be set for the movement of the friction elements 52 through the cross-bores 50. By changing these values along the friction elements 52, a desired path/force characteristic line can also be set up. Thus, in the event of a fall the friction force of the friction elements 52 in the cross-bores 50 can initially be selected higher corresponding to the smaller deflection angle at the beginning of a deflection of the rail 10.

As can be recognized in FIGS. 1 and 5, a safety stirrup 60 is housed movable at a right angle to the rail 10 at the end-plate 54 in recesses 58 which are flush with the groove 21 between the flanges. The safety stirrup 60 is pressed against the flange pair 18, 20 by coil compression springs 62 inside the end-plate 54, so that the runner 14 cannot fall out of the end of the rail 10 in the normal position of the safety stirrup 60. In order to loosen the runner 14 from the rail 10 the safety stirrup 60 must firstly be pressed away from the flange pair 18, 20 by hand, as indicated in FIG. 1 by the arrow 64.

FIGS. 6, 7 and 8 show details of the expansion joint. Expansion joints may be necessary at intervals when there are narrow deflections, in order to compensate for changes in length caused by temperature. Two rail pieces 11 are connected at an expansion joint by means of a joint piece 70. The joint piece 70 is a solid material profiled piece similar to an extension piece and a connecting piece, whose outer contour corresponds to the inner contour of the rail 10. As the flanges 18, 20, 22, 24 are hollow, the joint piece 70 has corresponding flanges which are however narrower and lower by an amount equal to the material thickness of the rail 10. The joint piece is pushed approx 10 cm into one rail piece 11 and is fixed by means of countersunk screws. The other rail piece 11 is to be able to travel on the joint piece 70 to compensate for changes in length caused by temperature. To this end, the flat outer sides of the joint 70 contain slotted openings 72 in which a groove block 74 is guided which is likewise fixed in the inside of the other rail piece 11 by countersunk screws. The length of the opening 72 limits the maximum permissible relative movement of the two rail pieces 11.

In order to prevent the runner 14 from sticking at such an expansion joint, substitute guides 76 are provided in the two grooves 21 between the flange pairs. The substitute guides 76 have a profile comprising two parallel running channels. They are screwed fast 7 to the joint piece 70 and lie in the grooves 21 of the rail 10 tightly against the insides of the flanges 18, 22 and 20, 24 respectively. The substitute guides 76 are pressed in the grooves of the rail pieces 11 with a slight pre-tension so that they lie tightly against the inside of the flanges 18, 22 and 20, 22 respectively and can be crossed by the runner without a jolt. The ends of the runner 14 running in the channels of the substitute guides 76 are therefore guided. These substitute guides 76 ensure that the runner 14 slides largely jolt-free over an expansion joint. Because the joint piece 70 also has flanges, security against a fall is also ensured when crossing the expansion joint.

FIG. 9 shows how the rail 10 can be reinforced by an identical rail 80 running parallel to it. The two rails 10, 80 are clamped together by means of clamps 82, which grasp around the flange pairs of the two rails 10, 80 directed towards each other and are clamped together by a screw 84. Such a reinforcing can be expedient for bridging particularly large distances between the holders 12. The reinforcing rail 80 thus extends in general only over the middle area of the rail 10 between two holders 12.

FIG. 10 shows the installation of heating strips 86 inside the hollow flanges 18, 20. Such heating strips are made from plastic matrix filled with carbon having PTC-resistor properties and are generally known. The icing of the rail 10 can be prevented by means of such heating strips 86.

FIGS. 11 and 12 show curved pieces 90, which each represent a 90° bend. The curved pieces 90 are produced by first turning a solid material ring e.g. made from aluminium, with a profile corresponding to the rail 10. Individual curved pieces 90 can then be cut out of this ring with the desired bend angle. Threaded bores 92 are cut in the end-surfaces of the curved pieces 90. Connecting pieces 96 with a profile identical to the inside contour of the rail 10 and made from solid material with a central bore are clamped tight by means of a central screw 94 which is screwed into the threaded bore 92. As shown in FIG. 12, when in use, connecting pieces 96 are clamped tight to both end-surfaces of the curved piece 90. The flange height or width can be somewhat reduced inside the curved piece 90 in order to enable a problem-free negotiation of the curved piece 90 with the runner 14.

FIGS. 13 to 15 show a rail switch point 100. The rail switch point 100 consists of two converging curved pieces 102, 104. The rail switch point 100 is milled from solid aluminium material and, in an area 105 of approx 2 cm along the flange of one curved piece 102, 104, the respective other curved piece 104 or 102 is cut out. The depth of the cut corresponds to half the dimension of the rail 10 across the flange sides (FIG. 14). To compensate for this weakness in the material, a reinforcing plate 108 is screwed onto the base of the rail switch point 100. Connecting pieces 110, to which rail pieces 11 can be screwed, are located at the three end-points of the rail switch point 100. Total security against a fall is always ensured when crossing the rail switch point 100. When crossing the rail switch point 100, the runner 14 always grasps a flange over the total length of one side and likewise around one flange at least at one point of the other side. Because of this three-point holding, the runner cannot fall out of the rail switch point 100. An advantage of this switch point is that it has no moving parts. The choice of direction is made by corresponding manual contact pressure. A single switch point type allows all changes of direction and the bringing together and separation of rails.

In the version of FIG. 2, the runner 14 contains two half-shells 26, 27, which are welded onto a block 28 lying between them. Each of the half-shells 26, 27 grasps a flange 18, 20 respectively of the rail 10. A bore 29 is provided in the block 28, in which the snap hook of a safety harness can be suspended.

As is indicated in FIG. 2 by the dashed line 112, the half-shells 26, 27 are undercut so that they each have contact with the flanges 18, 20 of the rail 10 only at their front and rear ends. Firstly, the negotiation of curves is thereby facilitated, and secondly, the ends of the half-shells 18, 20 can be more precisely worked, which means the runner 14 slides more easily on the rail 10. In the embodiment of FIG. 2, the half-shells 26, 27 are welded securely onto the block 28 so that the runner 14 can only be detached from the rail 10 or pushed onto it at the end of the rail.

FIGS. 16 to 20 show a version of the runner 14 where the half-shells 26, 27 can be opened so that the runner 14 can be fitted onto the rail 10 on any desired point on the rail 10, and secondly the runner 14 can also fulfil an arrester function and can thereby also be used on vertical climbing tracks. The arrester function is sometimes also desired for a horizontal or sloped rail course, e.g. to be able to lean away from the rail 10. The two half-shells 26, 27 are housed rotatable and movable on an eccentric axis 114 (FIG. 17). To this end, bushings 118, 120 are provided on both sides, on bearing sections 116 of each half-shell 26, 27. The half-shells 26, 27 are pushed onto the eccentric axis 114 with these bushings. The inner bushings 118 have a greater internal diameter than the outer bushings 120 and the eccentric axis 114 is provided with a corresponding diameter graduation 122. One half-shell 26 is held by a milled nut 124 and the other half-shell 27 by a lever grip 136 fastened on the end of the eccentric axis 114, movable on the eccentric axis 114. The eccentric axis 114 is offset in the center so that an eccentric section 128 results. An arrester lever 130 is housed on the eccentric section 128 which has a longer lever arm 132 with a lug for suspending the snap hook 15 of the safety harness and a shorter lever arm 134 for arresting the runner 14 on the rail 10. The eccentric axis 114 can be rotated by the lever grip 136 so that the distance from the eccentric 128 to the rail 10 changes. The arrangement is such that the shorter lever arm 134 cannot be swivelled past on the rail if the eccentric 128 is located in its position near to the rail 10. On the other hand, the shorter lever arm 134 can be freely swivelled past on the rail 10 if the eccentric axis 114 is rotated into the position in which the eccentric 128 is at its greatest distance from the rail 10. If the eccentric 128 is located in its position near to the rail, the runner 14 can be moved only in one direction along the rail 10, the longer lever arm 132 then pointing in the direction of movement while the shorter lever arm 134 points against the direction of movement. For a vertical climbing track, the runner 14 is used so that the short lever arm 134 points diagonally downwards towards the rail 10 so that the runner 14 is arrested at the rail 10 in the event of a fall.

The eccentric axis 114 can be fixed both in its arrester position, in which the eccentric 128 is swivelled towards the rail 10, and in the free-running position, in which the eccentric 128 is swivelled away from the rail 10. To this end, a cross-bore 138 is provided in the lower small bushing 120 in FIG. 16, which is congruent with an aligned cross-bore 140 in the eccentric axis 114 in the arresting position and in the release position. By means of a safety stirrup 142, the ends of which penetrate the cross-bores 138 of the bushing 120 in the fixed state and engage partially with the cross-bore 140 of the eccentric axis 114 from both sides, the eccentric axis 114 is fixed in the half-shell 26. The safety stirrup 142 locks into a groove 144 on the top of the milled nut 124. To loosen the fixing, the safety stirrup 142 is swivelled about the cross-bores 138, 140. In the vicinity of the cross-bores 138, 140 the two legs of the safety stirrup 142 are guided in notches 150 which are formed in an edge flange 148 of the bushing 120, the two notches 150 diverging from each other. When the safety stirrup 142 is swivelled sideways its ends are forced apart by the diverging notches so that they release the eccentric axis 114 and the eccentric axis 114 can be rotated by 180° by means of the lever grip 136. In this rotation position, the eccentric axis 114 can then be fixed by swivelling back the safety stirrup 142.

Through a leg spring, not shown, which sits between the lever 130 and the bearing section 116 of the half-shell 26 and/or 27 on the large bushings 118, the lever 130 is pressed into an at-resting position in which the shorter lever arm 134 points towards the rail 10 and the longer lever arm 132 away from the rail 10. If the arresting function is engaged, the runner 14 is thereby arrested without a load at the rail 10. According to FIG. 19 a path limiter can be provided in the form of a nose 152 at the large bushings 118 and a pin 154 can project from the lever 130 so that the lever 130 can assume a defined maximum angle relative to the rail 10 of less than 90°. This path limiter simultaneously fixes the maximum braking force when the runner 14 is arrested at the rail 10. The nose 152 is arranged on the side of the bushing 118 facing away from the rail so that the pin 154 impacts against this nose 122 only when the arresting function is engaged. When the arresting function is disengaged, on the other hand, it can be moved over the nose 152.

The lever 130 is expediently constructed from several thin plates or sheets which are riveted together. In addition, the eccentric 128 has roughly the same diameter as the adjacent diameter-sized sections of the eccentric axis 114. The sheets can thereby be pushed individually from these sections onto the eccentric 128 by tilting them slightly. Only thereafter are the plates welded together. There is the further advantage that when there is a cross-pull on the longer lever arm 132 in the direction of the eccentric axis 114, the individual plates can move somewhat against other and thereby the tilting moment onto the eccentric 128 is reduced.

To open the runner 14, the safety stirrup 142 is first swivelled away from the milled nut 124 so that its ends no longer lie in the cross-bore 140 of the eccentric axis 114, and the milled nut 124 is unscrewed to the extent that the two half-shells 26 and 27 can be pushed away from each other on the eccentric axis 114 and the runner 14 can thereby be fitted onto the rail 10 or removed from it. In its closed position, the runner 14 is secured by the milled nut 124 and in addition by the safety stirrup 142, the safety stirrup 142 simultaneously preventing the milled nut 124 from unscrewing.

What is claimed is:

1. A device for safeguarding a person against falling, comprising:

a rail having a profile with a first and a second flange pair on each of two opposite-facing side surfaces of the profile, the flanges of each flange pair pointing away from each other, the rail being designed to resist a basic load without deformation but to deflect when subjected to a falling force resulting from an extreme fall, the falling force exceeding the basic load;

holders supporting the rail such that the rail is mounted moveable in the holders in its longitudinal direction, each of the holders having a U-bracket opened to the top and including two legs and a claw fastened to the end of one of the legs and grasping around the first flange pair; and a runner guided along the rail, the runner grasping around the second flange pair and functioning at a moveable attachment point for a person to be safeguarded against falling;

wherein the rail will be deflected in the event of an extreme fall, the deflection leading to a longitudinal stress inside the rail and to a longitudinal movement of the rail in at least one of the holders.

2. The device according to claim 1, wherein each of the holders includes friction-reducing inserts.

3. The device according to claim 2, wherein the friction-reducing inserts are made from polytetrafluoroethylene.

4. The device according to claim 1, wherein the rail has a closed hollow profile with a roughly square cross-section and is symmetrical about both a horizontal and a vertical axis.

* * * * *

UNITED STATES PATENT AND TRADEMARK OFFICE

CERTIFICATE OF CORRECTION

PATENT NO. : 6,571,912 B2
DATED : June 3, 2003
INVENTOR(S) : Peter Söll

It is certified that error appears in the above-identified patent and that said Letters Patent is hereby corrected as shown below:

Column 7,
Line 30, "flanges 18, 22 and 20, 22" should read -- flanges 18, 22 and 20, 24 --.

Signed and Sealed this

Twenty-first Day of October, 2003

JAMES E. ROGAN
*Director of the United States Patent and Trademark Office*